US010150932B2

(12) United States Patent
Opalka et al.

(10) Patent No.: US 10,150,932 B2
(45) Date of Patent: Dec. 11, 2018

(54) AUXILIARY EMERGENCY PROTECTIVE LUBRICATION SYSTEM FOR METAL MECHANICAL COMPONENTS

(71) Applicant: United Technologies Corporation, Farmington, CT (US)

(72) Inventors: Susanne M Opalka, Old Chatham, NY (US); Huan Zhang, Glastonbury, CT (US); Zaffir A Chaudhry, South Glastonbury, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 16/018,274

(22) Filed: Jun. 26, 2018

(65) Prior Publication Data

US 2018/0298303 A1 Oct. 18, 2018

Related U.S. Application Data

(62) Division of application No. 15/217,068, filed on Jul. 22, 2016, now Pat. No. 10,035,969.

(51) Int. Cl.
*C10M 169/04* (2006.01)
*C10M 125/22* (2006.01)
(Continued)

(52) U.S. Cl.
CPC ..... *C10M 169/04* (2013.01); *C10M 125/00* (2013.01); *C10M 125/02* (2013.01); *C10M 125/22* (2013.01); *C10M 125/26* (2013.01); *F01D 25/18* (2013.01); *C10M 2201/041* (2013.01); *C10M 2201/065* (2013.01); *C10M 2201/066* (2013.01); *C10M 2201/087* (2013.01); *C10M 2201/102* (2013.01); *C10M 2203/024* (2013.01); *C10M 2203/065* (2013.01); *C10M 2203/1006* (2013.01); *C10M 2207/0406* (2013.01); *C10M 2207/2835* (2013.01);
(Continued)

(58) Field of Classification Search
CPC ..... C10N 2220/022; C10N 2240/10; C10M 2203/1006; C10M 2207/2835; C10M 2207/0406; C10M 2203/065; C10M 2203/024; C10M 2201/102; C10M 2201/066; C10M 2201/065; C10M 2201/041
USPC ..... 508/110; 184/6.11; 977/773
See application file for complete search history.

(56) References Cited

U.S. PATENT DOCUMENTS 4,717,000 A 1/1988 Waddington et al.
6,223,616 B1 5/2001 Sheridan
(Continued)

FOREIGN PATENT DOCUMENTS

CN 105062617 A 11/2015
EP 2298853 A1 3/2011

OTHER PUBLICATIONS

Koshy Chacko Preno et al: "Evaluation of the tribological and thermo-physical properties of coconut oil added with MoS2 nanoparticles at elevated temperatures", WEAR, vol. 330, Jan. 5, 2015, pp. 288-308, XP029231100, ISSN: 0043-1648, DOI: 10.1016.
(Continued)

*Primary Examiner* — Vishal V Vasisth
(74) *Attorney, Agent, or Firm* — Bachman & LaPointe, P.C.

(57) ABSTRACT

An auxiliary lubricant comprising a composition, the comprising intermediate molecular weight surfactant-functionalized nanoparticles dispersed in a base oil.

6 Claims, 2 Drawing Sheets

(51) Int. Cl.

| | |
|---|---|
| ***C10M 125/26*** | (2006.01) |
| ***F01D 25/18*** | (2006.01) |
| ***C10M 125/00*** | (2006.01) |
| ***C10M 125/02*** | (2006.01) |

(52) U.S. Cl.
CPC .. *C10N 2220/082* (2013.01); *C10N 2220/084* (2013.01); *C10N 2230/06* (2013.01); *C10N 2240/12* (2013.01); *C10N 2250/12* (2013.01); *F05D 2220/32* (2013.01); *F05D 2260/98* (2013.01)

(56) References Cited

U.S. PATENT DOCUMENTS

| | | | |
|---|---|---|---|
| 7,174,997 | B2 | 2/2007 | Sheridan |
| 9,086,055 | B2 | 7/2015 | Subramaniam et al. |
| 9,284,508 | B2 | 3/2016 | Baran, Jr. et al. |
| 2005/0175649 | A1 | 8/2005 | Disalvo et al. |
| 2014/0001307 | A1 | 1/2014 | Ehinger et al. |
| 2014/0231145 | A1 | 8/2014 | Kverel et al. |

OTHER PUBLICATIONS

Database WPI, Thomson Scientific, London, GB; AN2015-78892B, XP002773825.

AUXILIARY EMERGENCY PROTECTIVE LUBRICATION SYSTEM FOR METAL MECHANICAL COMPONENTS

CROSS-REFERENCE TO RELATED APPLICATIONS

The instant application is a divisional application of U.S. patent application Ser. No. 15/217,068 filed Jul. 22, 2016, now U.S. Pat. No. 10,035,969.

BACKGROUND

The present disclosure is directed to auxiliary lubrication, and more particularly use of a back-up auxiliary lubrication system for lubrication failure emergencies to provide temporary protection and cooling of mechanical components.

Lubrication systems, such as those used in aircraft gas turbine engines, supply lubricant to bearings, gears and other engine components that require lubrication. The lubricant, typically oil, cools the components and protects them from wear. A typical oil lubrication system includes conventional components such as an oil tank, pump, filter and oil supply conduits.

Lubrication systems circulate lubricant fluids to reduce friction, wear, and corrosion; clean, and seal mechanically moving gear, bearing, and piston metal part surfaces in transportation vehicles and stationary power equipment as well as to provide cooling of integrated fuel systems. Lubrication systems are typically comprised of tanks for the base oil or fluid, de-aerators, filters, by-pass valves, oil coolers/heat exchangers, and sumps or drains.

If one of the lubrication system components fails, malfunctions or sustains damage, the oil supply to the lubricated component may be disrupted resulting in irreparable damage to the component and undesirable corollary consequences. For example, if an engine oil pump fails or a supply conduit develops a severe leak, the resulting loss of oil pressure could disable the engine by causing overheating and/or seizure of the bearings.

Lubrication protection can be compromised by the depletion of lubricant additives, contamination of the lubricant with other fluids, development of a leak in the lubricant system, or gases, or the plugging of the system filters, valve jets or actuators, or channels. The loss of lubricant circulation, oil starvation, or breakdown of lubricity causes increased friction heating, wear, and vibration, ultimately leading to several possible modes of catastrophic failures, including welding and seizing of mechanical parts or even fire.

SUMMARY

In accordance with the present disclosure, there is provided an auxiliary lubricant comprising a composition comprising intermediate molecular weight surfactant-functionalized nanoparticles dispersed in a base oil.

In another and alternative embodiment, the nanoparticles comprises at least one of a carbon-containing phase and an inorganic phase.

In another and alternative embodiment, the nanoparticles in the inorganic phase are selected from the group consisting of boric acid, metal sulfides, and alkali silicates.

In another and alternative embodiment, the metal sulfide comprises Zn, W and Mo.

In another and alternative embodiment, the alkali silicate comprises Na and K.

In another and alternative embodiment, the carbon-containing phase comprises at least one of graphene, ultra-dispersed nano-crystalline diamond and graphite, spheroidal carbons, and carbon nanorods.

In another and alternative embodiment, the nanoparticles comprise a dimension ranging from about 1 nanometer to about 20 nanometers.

In another and alternative embodiment, the nanoparticles comprise a dimension less than 1 nanometer.

In another and alternative embodiment, the nanoparticles comprise a narrow-size distribution with an aspect ratio greater than 2.

In another and alternative embodiment, the nanoparticles are functionalized with amphoteric surfactants containing alcohol, amine, carboxylic acid, carbonate, ester, ether alcohol, sulfate, sulphonate, phosphate, phosphite, or phosphonate head groups and intermediate molecular weight hydrocarbon, fluorocarbon, or siloxane tails.

In another and alternative embodiment, the nanoparticles are dispersed in a carrier base oil.

In another and alternative embodiment, the carrier base oil is selected from the group consisting of mineral oils, polyol esters, polyalkylene glycols, alkylbenzenes, polyalphaolefins, and polyvinyl. In an exemplary embodiment, the polyol esters are dipentaerythritol hexanoic acid esters.

In another and alternative embodiment, the nanoparticles comprise a size and a geometry configured to provide an asperity-asperity separation in a boundary lubrication regime.

In another and alternative embodiment, the lubricant is configured to lubricate through multiple lubrication regimes, the multiple lubrication regimes comprising at least one of a boundary lubrication regime, mixed lubrication regime; an elasto-hydrodynamic lubrication regime; and a hydrodynamic lubrication regime.

In accordance with the present disclosure, there is provided an auxiliary lubricant system comprises an auxiliary lubricant reservoir configured to contain and release an auxiliary lubricant, the auxiliary lubricant comprising a composition comprising intermediate molecular weight surfactant-functionalized nanoparticles dispersed in a base oil; at least one fluid delivery device fluidly coupled to the auxiliary lubricant reservoir; at least one lubricant supply line fluidly coupled to the auxiliary lubricant reservoir; at least one system component fluidly coupled to the auxiliary lubricant reservoir via the at least one lubricant supply line, wherein the at least one system component is lubricated by a lubricant; and an off-normal instrumentation and control device coupled to the auxiliary lubricant reservoir configured to actuate at least one fluid delivery device to deliver the auxiliary lubricant to the at least one system component responsive to an off-normal system event.

In another and alternative embodiment, the nanoparticles comprises at least one of a carbon-containing phase and an inorganic phase.

In another and alternative embodiment, the nanoparticles are functionalized with amphoteric surfactants containing alcohol, amine, carboxylic acid, carbonate, ester, ether alcohol, sulfate, sulphonate, phosphate, phosphite, or phosphonate head groups and intermediate molecular weight hydrocarbon, fluorocarbon or siloxane tails.

In another and alternative embodiment, the nanoparticles are dispersed in a base stock.

In another and alternative embodiment, the lubricant is configured to lubricate through multiple lubrication regimes, the multiple lubrication regimes comprising at least one of a boundary lubrication regime, mixed lubrication regime; an elasto-hydrodynamic lubrication regime; and a hydrodynamic lubrication regime.

In another and alternative embodiment, the protective layers that can be formed by the auxiliary lubricant after off-normal events can block metal surface-catalyzed coke formation.

Other details of the auxiliary lubrication are set forth in the following detailed description and the accompanying drawing wherein like reference numerals depict like elements.

DETAILED DESCRIPTION

Figure 1:
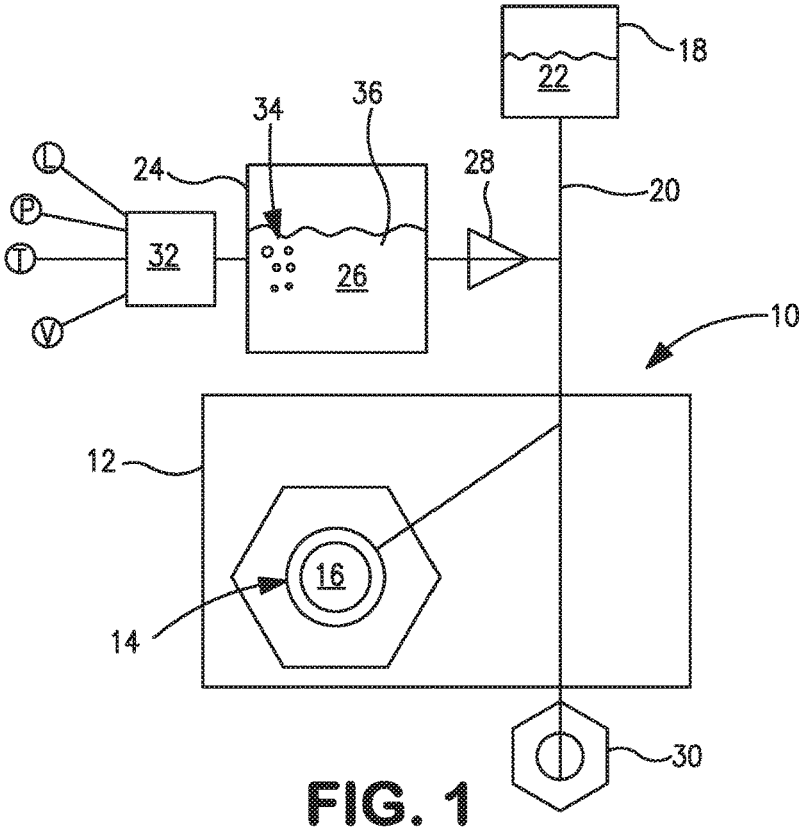
FIG. 1 is a schematic representation of an exemplary lubrication system for a gas turbine engine.

Referring now to FIG. 1, a gas turbine engine can include a bearing compartment 10 defined by an enclosure 12. A bearing 14 resides within the compartment and supports an engine rotor or shaft 16.

A lubricant reservoir 18 is fluidly coupled to the bearing 14. The bearing 14 bearing rolling elements can be comprised of metals, including steels, and high nitrogen martensitic steels, or ceramics, including silicon nitride, silicon carbide, alumina, and zirconia. The race or ring contact surfaces can be comprised of steels or other metals. A lubricant supply line 20 couples the bearing 14 and reservoir 18. The reservoir 18 contains primary lubricant 22.

An auxiliary lubricant reservoir 24 is fluidly coupled to the lubricant supply line 20. The auxiliary lubricant reservoir 24 contains an auxiliary lubricant 26. A fluid/lubricant delivery device 28, such as a pump or stored hydraulic/pneumatic pressure, gravity and the like, can be fluidly coupled to the auxiliary lubricant reservoir 24 configured to deliver the lubricant 26. The auxiliary lubricant reservoir 24 can be utilized to supply the auxiliary lubricant 26 in the event of an off-normal operation. The auxiliary lubricant reservoir 24 can also be directly coupled to the bearing 14, or any other component or system requiring lubrication normally supplied by the lubricant supply 18. The auxiliary lubricant 26 can be dispensed by the lubricant delivery device 28 as a liquid, spray, or mist from the auxiliary lubricant reservoir 24. The auxiliary lubricant reservoir 24 can be redundantly plumbed directly or indirectly to the bearing 14, as well as, critical system mechanical components 30 that require lubrication.

The components 30 that require lubrication can comprise surfaces made from a variety of materials, such as, metals alloys (iron/steels, copper/brass, nickel alloys, aluminum alloys, tin), ceramics (carbides, nitrides, borides, and their mixed phases), and hybrid metal/ceramic combinations. The surfaces that require lubrication such as, metal surfaces and many ceramics, are typically passivated with native oxides and are polar/hydrophilic in character.

An off-normal instrumentation and control device 32 can be coupled to the auxiliary lubricant reservoir 24. The off-normal instrumentation and control device 32, (i.e., I&C) is configured to actuate the fluid delivery device 28 to deliver the auxiliary lubricant 26 to at least one system component 30 and/or bearing 14 responsive to an off-normal system event/occurrence.

In an exemplary embodiment, the auxiliary lubricant 26 can be available responsive to an off-normal system occurrence sensed by the instrumentation and controls device 32. Examples of sensed off-normal system occurrences include a lubrication supply line rupture or a lubricant reservoir failure causing a level L change, a lubricant pump failure, lubricant valve failure, and the like causing a change or reduction in system pressure P, a temperature increase in primary lubricant T, a change in vibration V, or other instrumentation and controls device 30 signal that may indicate a loss of lubricant event.

The auxiliary lubricant 26 may be a liquid-based system having a plurality of nanoparticles 34 dispersed in a liquid-based medium, carrier base oil 36. In an example, the auxiliary lubricant 26 is a water-based system. In another example, the auxiliary lubricant 26 can be a hydrocarbon liquid-based system. The carrier 36 base oils can include mineral oils, polyol esters (synthetic oils), polyalkylene glycols, alkylbenzenes, polyalphaolefins, or polyvinyl ethers. In an exemplary embodiment the polyol esters are dipentaerythritol hexanoic acid esters, which have the highest temperature stability of up to near 300° C. (572° F.).

Figure 2:
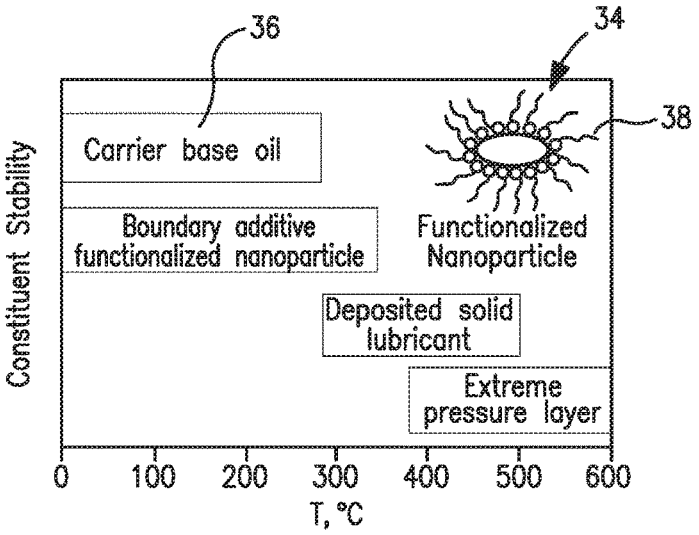
FIG. 2 is a graphic illustration of the stability of lubricant constituents as a function of temperature.
Figure 3:
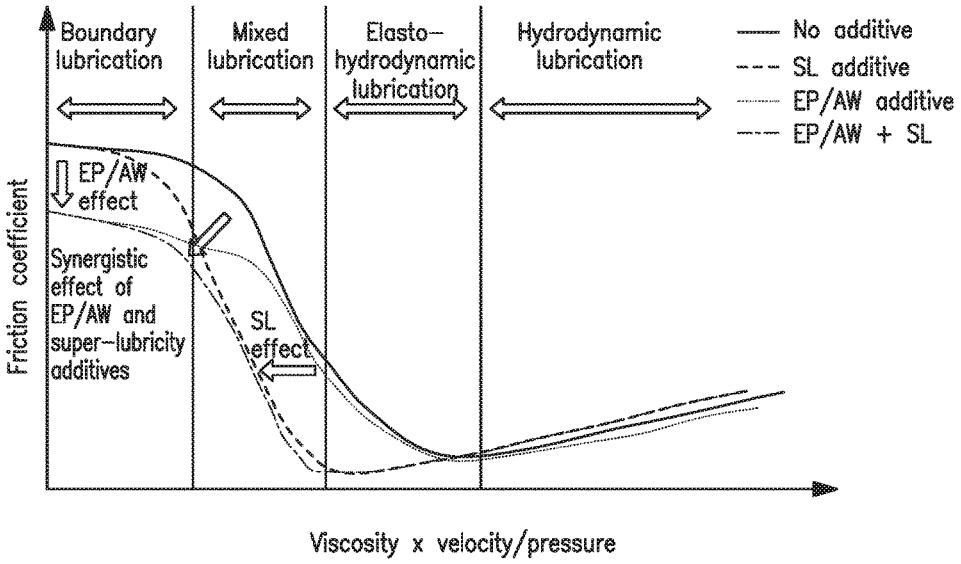
FIG. 3. Is a graphic illustration of the Stribeck curve for different lubrication regimes exhibited by the exemplary auxiliary lubricant.

Referring also to FIG. 2 and FIG. 3, in an exemplary embodiment, the auxiliary lubricant 26 formula can contain intermediate molecular weight surfactant-functionalized nanoparticles 34 dispersed in a base oil 36 having high temperature stability.

In an exemplary embodiment, the nanoparticles 34 are an inorganic phase, for example, boric acid, a metal (Zn, W, Mo) sulfide, or an alkali (Na, K) silicate. In an exemplary embodiment materials of the nanoparticles can include materials such as, lamellar compounds such as alkaline earth (Mg) silicates and their hydroxides (i.e., talc), carbon-containing phases, such as graphene (oxide), ultradispersed nano-crystalline diamond, or graphite, spheroidal carbons, including fullerenes and carbon nanorods; silver or other soft metals with low vapor pressures (indium, copper, tin), the hexagonal form of boron nitride, alkaline earth halides, like CaF2, or rare earth fluorides, like CeF3.

In an exemplary embodiment, the largest dimension of the nanoparticles 34 would be less than 20 nanometers, preferably less than 1 nm, to enhance their stable suspension and dispersion by Brownian motion.

In an exemplary embodiment, the nanoparticles 34 have a narrow-size distribution with an aspect ratio (length to radius) greater than 2. The nanoparticles can be rods, spherical or ellipsoidal shapes.

In an exemplary embodiment, the nanoparticles 34 are functionalized with amphoteric surfactants 38 containing alcohol, amine, carboxylic acid, carbonate, ester, ether alcohol, sulfate, sulphonate, phosphate, phosphite, or phosphonate head groups and intermediate molecular weight hydrocarbon, fluorocarbon, or siloxane tails. In an exemplary embodiment boundary additives include amphiphilic surfactant compounds, containing a polar functional group with heteroatoms (other atoms besides carbon or hydrogen) at the end of intermediate molecular weight tails. The surfactant endgroups can either physisorb (weak, associative bonding), or chemisorb (strong, covalent or ionic bonding) on the nanoparticle surfaces. The strength of the bonding interaction depends on the surfactant endgroup, and the difference in the acid-base character of the endgroup and the nanoparticle surface. The surfactant bonding interactions can be reversible, to enable desorption and readsorption on mechanical contact surfaces at higher temperatures.

In an exemplary embodiment, the endgroup can be anionic (negatively charged polar functional group); carboxylates—including fatty acids; sulfates; sulphonates phosphates, phosphonates, and phosphites. The endgroup can also include nonionic (polar functional group not charged), such as, alcohols, ether alcohols, and esters. The endgroups can also include cationic (positively charged) polar functional groups, such as, amines.

The intermediate molecular weight tails have backbones with 15-30 atoms in length, to enable their extension and flexibility in solution with minimum entanglement. The backbones can be formed from hydrocarbons (straight or branched alkyls, olefinics, or aromatics), fluorocarbons, or siloxanes.

In an exemplary embodiment, the surfactant head groups are adsorbed on the nanoparticle surfaces, leaving their intermediate molecular weight tails to extend out and form a boundary-like layer around their surfaces.

In an exemplary embodiment, the functionalized nanoparticles 34 are dispersed in the carrier base oil 36. In an exemplary embodiment, the base oil 36 can comprise dipentaerythritol hexanoic acid esters, which is the polyol ester with the highest temperature stability of up to near 300° C. (572° F.).

In an exemplary embodiment, the functionalized nanoparticle 34 dispersion is also miscible with residual primary lubricant 22. The surfactant 38 tails sterically prevent nanoparticle 34 aggregation for effective mixed or boundary lubrication.

The functionalized nanoparticle size and geometry is tailored to provide adequate asperity-asperity (i.e., peak-to-peak) separation in the boundary lubrication regime.

In an exemplary embodiment, an intermediate concentration of the auxiliary lubricant 26, for example on the order of 0.03 lbs./gal (35.95 kg/m$^3$), would provide benefit to the critical system components 30 in an off-normal event, reducing friction by 30%, yielding friction coefficients of <<0.1.

Referring again to FIG. 2, the thermal stability of the lubricant constituents is illustrated as a function of the lubricant and surface temperatures within the mechanically working contact. The multi-functional characteristics are supported by the various composition constituents in the auxiliary lubricant 26.

With increasing lubricant and surface temperatures from inadvertent overheating or increasing load pressure in the mechanical contact, the auxiliary lubricant 26 constituents can evolve to functionally transition through multiple lubrication regimes to provide broad spectrum protection to the bearing 14 or critical system components 30 during an off-normal event over a wide range of overall conditions and also local variations within the contact.

FIG. 3 is the Stribeck curve that illustrates the change of lubrication regimes depending on the Stribeck or bearing number, defined as the viscosity times the velocity divided by pressure, and the auxiliary lubricant 26. The friction coefficient is on the y-axis and the Stribeck or bearing number is on the X-axis. A lubricant with no additive, as shown by its Stribeck curve, is effective in the hydrodynamic and elastohydrodynamic regimes. The other three curves in FIG. 3 shows the improvement (friction coefficient reduction) in the mixed and boundary lubrication regimes provided by a lubricant with SL (super-lubricity) dispersed nano-particle additives, a lubricant with EP/AW (extreme pressure/anti-wear) reactive additives, and a lubricant with combined EP/AW and SL additives, respectively. The latter provides significant friction and heat generation reduction over a wide range of Stribeck numbers, including boundary, mixed and elasto-hydrodynamic lubrication regimes, in comparison to the lubricant with only SL or EP/AW additives.

At the relatively low mechanical contact temperatures up to 180° C. (356° F.), the auxiliary lubricant demonstrates mixed lubrication. During mixed film lubrication, multiple layers of functionalized nanoparticles can readily shear past one another, providing low coefficients of friction up to 0.05.

At intermediate mechanical contact temperatures up to 300° C. (572° F.), the auxiliary lubricant demonstrates mixed-film/boundary lubrication. In this regime, the surface separation between opposing asperities is decreased to the dimensions of rod diameter plus functionalized surface layers. The functionalized nanoparticles prevent direct contact between the substrate materials, leading to a coefficient of friction in the range of 0.05 to 0.07.

At high mechanical contact temperatures above 250° C. (482° F.), the auxiliary lubricant functions as a boundary lubricant. Above 250° C. (482° F.), the auxiliary lubricant surfactant desorbs from the nanoparticles and adsorbs to form functionalized monolayers, like a boundary layer, on working surfaces of the system components, such as the bearings.

Over the mechanical contact high temperature range of 300-500° C. (572-932° F.), the auxiliary lubricant transitions from functioning as a boundary lubricant to a solid lubricant. The surfactant desorption from the nanoparticles breaks the dispersion and causes the nanoparticles to aggregate and precipitate on the surfaces being lubricated. At these high temperatures, the organic surfactant boundary layer starts to thermally decompose, exposing the working surfaces. The precipitated nanoparticles then physisorb on the working surfaces forming a solid protective layer, which provides coefficients of friction of 0.05 up to 0.1. Solid lubricants are especially important for surfaces in high temperature, oxidizing atmospheres where base oils and surfactants would typically not survive.

At high temperatures above 380° C. (716 F) the auxiliary lubricant starts to function like an extreme pressure/anti-wear (EP/AW) lubricant. Nanoparticle phases weld to surfaces, bonding without causing accelerated wear compared to the accelerated chemical attack of typical extreme pressure additives, like those containing sulfur, phosphorus, or chlorine. The solid layer provides the highest temperature protection, possibly acting as a galvanic couple with the metal to provide corrosion and oxidation resistance. The protective layers that can be formed by the auxiliary lubricant after off-normal events can function as barriers also help to block metal surface-catalyzed coke formation. Alternatively, at the highest temperatures, nanoparticle-deposited phase may decompose to form intumescent chars that act as a physical flame barrier.

A back-up auxiliary lubrication system is needed for lubrication failure emergencies to provide temporary protection and cooling of mechanical components, in order to extend the window for implementing emergency shut-down or maintenance of the operating system within a reasonable response time.

The wide range of possible surfactant chemistries provides flexibility for tailoring the lubricant compatibility with different mechanical contact material combinations. The surfactant-functionalized nanoparticles are hydrophobic in character, enabling their dissolution and dispersion in lubricating oils. The anchoring of the surfactant intermediate molecular weight backbones on the nanoparticle surfaces sterically prevents their aggregation and precipitation under low deformation conditions and at low temperatures.

The dispersion can immediately provide lubrication protection when dispensed in an undiluted form, and also provide lubricity when diluted with residual primary lubricant, for example, with any that remains in the lubrication system tanks or sumps.

The successful durability and life of engine components is dependent upon continuous lubrication protection of the working metal surfaces. The auxiliary lubrication system will extend the critical response time for implementing emergency shut-down or maintenance of the operating system to enable a reasonable response time.

The emergency dispensing of a back-up lubricant will prevent or delay of catastrophic failure, and will mitigate repair, safety, and property damage issues.

Another advantage of auxiliary lubrication system is that it can provide extended protection as the components of the system heat up to increasing temperatures and transition through multiple lubrication regimes. Traditional lubricant additive systems are tailored to perform in one or two specific lubrication regimes.

There has been provided an auxiliary emergency protective lubricant and system. While the auxiliary lubricant has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. An auxiliary lubricant system comprising:

an auxiliary lubricant reservoir configured to contain and release an auxiliary lubricant, said auxiliary lubricant comprising a composition comprising intermediate molecular weight surfactant-functionalized nanoparticles dispersed in a base oil wherein the intermediate molecular weight surfactant-functionalized nanoparticles comprise head groups adsorbed on nanoparticle surfaces, leaving intermediate molecular weight tails extended out and forming a boundary-like layer around the nanoparticle surfaces, said intermediate molecular weight tails having backbones 15-30 atoms in length;

at least one fluid delivery device fluidly coupled to said auxiliary lubricant reservoir;

at least one lubricant supply line fluidly coupled to said auxiliary lubricant reservoir;

at least one system component fluidly coupled to said auxiliary lubricant reservoir via said at least one lubricant supply line, wherein said at least one system component is lubricated by a lubricant; and an off-normal instrumentation and control device coupled to said auxiliary lubricant reservoir configured to actuate at least one fluid delivery device to deliver said auxiliary lubricant to said at least one system component responsive to an off-normal system event.

2. The auxiliary lubricant system of claim 1, wherein nanoparticles comprises at least one of a carbon-containing phase and an inorganic phase.

3. The auxiliary lubricant system of claim 1, wherein said nanoparticles are functionalized with amphoteric surfactants containing alcohol, amine, carboxylic acid, carbonate, ester, ether alcohol, sulfate, sulphonate, phosphate, phosphite, or phosphonate head groups and intermediate molecular weight hydrocarbon, fluorocarbon or siloxane tails.

4. The auxiliary lubricant system of claim 1, wherein said nanoparticles are dispersed in a base stock.

5. The auxiliary lubricant system of claim 1, wherein said lubricant is configured to lubricate through multiple lubrication regimes, said multiple lubrication regimes comprising at least one of a boundary lubrication regime, mixed lubrication regime; an elasto-hydrodynamic lubrication regime; and a hydrodynamic lubrication regime.

6. The auxiliary lubricant system of claim 5, wherein said protective layers that can be formed by the auxiliary lubricant after off-normal events can block metal surface-catalyzed coke formation.

* * * * *